US006585574B1

(12) United States Patent
Lombardo et al.

(10) Patent No.: US 6,585,574 B1
(45) Date of Patent: Jul. 1, 2003

(54) POLISHING PAD WITH REDUCED MOISTURE ABSORPTION

(76) Inventors: Brian Lombardo, 11 Buckridge Dr., Amherst, NH (US) 03031; Rajeev Bajaj, 43651 Skye Rd., Fremont, CA (US) 94555

( * ) Notice: Subject to any disclaimer, the term of this patent is extended or adjusted under 35 U.S.C. 154(b) by 0 days.

(21) Appl. No.: 09/596,842

(22) Filed: Jun. 19, 2000

Related U.S. Application Data

(63) Continuation-in-part of application No. 09/317,974, filed on May 25, 1999, now abandoned.
(60) Provisional application No. 60/087,742, filed on Jun. 2, 1998.

(51) Int. Cl.[7] ..... B24B 5/00
(52) U.S. Cl. ..... 451/285; 451/526; 451/530; 451/533
(58) Field of Search ..... 451/41, 285, 287, 451/288, 526, 528, 530, 533

(56) References Cited

U.S. PATENT DOCUMENTS 5,578,362 A 11/1996 Reinhardt et al.
6,069,080 A * 5/2000 James et al. ..... 438/691
6,095,902 A * 8/2000 Reinhardt ..... 451/36
6,117,000 A * 9/2000 Anjur et al. ..... 451/526
6,217,434 B1 * 4/2001 Roberts et al. ..... 451/548

FOREIGN PATENT DOCUMENTS

WO WO 99/06182 2/1999

* cited by examiner

*Primary Examiner*—Eileen P. Morgan
(74) *Attorney, Agent, or Firm*—Martine & Penilla, LLP

(57) ABSTRACT

A polishing pad for use in chemical mechanical polishing (CMP) is disclosed. The polishing pad has a pad surface for polishing wafer surfaces. The pad surface is composed of a polymeric matrix material. The polishing pad also contains a polymeric additive which is defined in the polymeric matrix of the pad surface and in cells of the pad surface. The polymeric additive may include one of a polyurethane, a polyamide, a polyester, a polyacrylonitrile, a polyacrylate, a polymethacrylate, a polyvinylchloride, and a polyvinylidene chloride. The polymeric additive is configured to be hydrophilic so that the pad surface is wettable to enable improved slurry distribution over the pad surface.

20 Claims, 2 Drawing Sheets

POLISHING PAD WITH REDUCED MOISTURE ABSORPTION

CROSS REFERENCE TO RELATED APPLICATION

This is a continuation-in-part of a co-pending U.S. patent application Ser. No. 09/317,974 entitled "Improved Polishing Pad with Reduced Moisture Absorption" filed on May 25, 1999 now abandoned, which was a nonprovisional application claiming priority from a U.S. Provisional Application No. 60/087,742, filed on Jun. 2, 1998.

BACKGROUND OF THE INVENTION

1. Field of the Invention

The present invention relates to semiconductor wafer polishing and, more particularly, to improved polishing pads to more efficiently polish wafer surfaces and decrease wafer polishing cost.

2. Description of the Related Art

In the semiconductor chip fabrication process, it is well-known that there is a need to polish a semiconductor wafer. This polishing is typically accomplished by a chemical mechanical polishing (CMP) process. Generally, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the higher variations in the surface topography. In other applications, metallization line patterns are formed in the dielectric material, and then, metal CMP operations are performed to remove excess metallization.

During CMP, a semiconductor wafer is polished by use of a polishing material, such as a belt or pad, and a solution known as a slurry. The polishing material is typically made from some hydrophilic polymer such as polyurethane. A more detailed discussion regarding polishing pads is stated below. The slurry is generally made up of an aqueous solution with metallic or non-metallic particulates such as, for example, aluminum or silica abrasives that create the added friction needed for the polishing process. In one example of a CMP process, a polishing pad is put in motion (rotated or moved in a conveyer belt fashion) and a slurry solution is applied and spread over the surface of the polishing pad. Once the polishing pad having slurry on it is moving at a desired rate, the wafer is lowered onto the surface of the pad. In this manner, the wafer surface that is desired to be planarized is substantially smoothed, much like sandpaper may be used to sand wood.

Currently available polishing pads, typically polyurethane foam, are limited in effectiveness and consistency because they readily absorb moisture. In use, polishing pads are in continuous contact with aqueous slurries and cleaning solutions. Moisture absorption affects the performance of polishing pads in the following two ways:

1) Softening, swelling, or loss of rigidity through physical and chemical degradation, resulting in reduced planarizing effectiveness and reduced lifetime of the polishing pad, 2) Gradual changes in pad properties and integrity during use, resulting in unsteady and inconsistent performance.

Previous attempts to make polishing pads with reduced moisture absorption or with increased resistance to degradation have been limited because the pads are too hydrophobic, resulting in poor wetting, inefficient slurry distribution, and reduced or varying removal rates.

SUMMARY OF THE INVENTION

Broadly speaking, this invention fills these needs by providing a moisture resistant polishing pad with additives to improve wetting of the pad surface for good slurry distribution. It should be appreciated that the present invention can be implemented in numerous ways, including as a process, an apparatus, a system, a device, or a method. Several inventive embodiments of the present invention are described below.

In one embodiment, a polishing pad for use in chemical mechanical polishing (CMP) is disclosed. The polishing pad has a pad surface for polishing wafer surfaces. The pad surface is composed of a polymeric matrix material. The polishing pad also contains a polymeric additive which is defined in the polymeric matrix of the pad surface and in cells of the pad surface. The polymeric additive may include one of a polyurethane, a polyamide, a polyester, a polyacrylonitrile, a polyacrylate, a polymethacrylate, a polyvinylchloride, and a polyvinylidene chloride. The polymeric additive is configured to be hydrophilic so that the pad surface is wettable to enable improved slurry distribution over the pad surface.

In another embodiment, a polishing pad for use in chemical mechanical polishing (CMP) is disclosed. The polishing pad has a pad surface for polishing wafer surfaces. The pad surface is composed of a relatively non-polar polymeric matrix material. An additive is defined in the polymeric matrix of the pad surface and in cells of the pad surface where the additive is a surfactant. The additive is hydrophilic so that the pad surface is wettable which enables improved slurry distribution over the pad surface.

In yet another embodiment, a polishing system including a polishing pad for use in chemical mechanical polishing (CMP) is disclosed. The polishing pad has a pad surface for polishing wafer surfaces. The pad surface is composed of a polymeric matrix material which is either a thermoplastic material or a cross-linked material. A relatively polar polymeric additive is defined in the polymeric matrix of the pad surface and in cells of the pad surface. The additive is one of a polyurethane, a polyamide, a polyester, a polyacrylonitrile, a polyacrylate, a polymethacrylate, a polyvinylchloride, and a polyvinylidene chloride. The additive is also hydrophilic so that the pad surface is wettable which enables improved slurry distribution over the pad surface. The polymeric matrix material also absorbs less than 4% moisture by weight. The thermoplastic material used to make the polymeric matrix material is selected from the group consisting of a polytetrafluoroethylene material, a polyethylene material, an acrylonitrile butadiene styrene (ABS) material, a polypropylene material, a fluoronated polymer material, a polyurethane material, a thermoplastic elastomer material, and a polycarbonate material. The cross-linked material used to make the polymeric matrix material is selected from the group consisting of a polyurethane material, a phenolic material, an epoxy material, a natural or synthetic rubber material, and a thermoset material.

In another embodiment, a polishing pad is disclosed. The polishing pad has a pad surface for polishing wafer surfaces where the pad surface is composed of a polymeric matrix material. The polymeric matrix material includes one of a thermoplastic material and a cross-linked material. The polymeric matrix material is defined by cells that extend into the pad while some cells at the pad surface define invaginated features for receiving the slurry. A polymeric additive is defined in the polymeric matrix of the pad surface and in the cells of the pad surface where the polymeric additive includes one of a polyamide and a polyester. The additive is made to be hydrophilic such that the pad surface is wettable to enable improved slurry distribution over the pad surface. The thermoplastic material used to make the polymeric matrix material is selected from the group consisting of a polytetrafluoroethylene material, a polyethylene material, an acrylonitrile butadiene styrene (ABS) material, a polypropylene material, a fluoronated polymer material, a polyurethane material, a thermoplastic elastomer material, and a polycarbonate material. The cross-linked material used to make the polymeric matrix material is selected from the group consisting of a polyurethane material, a phenolic material, an epoxy material, a natural or synthetic rubber material, and a thermoset material.

The advantages of the present invention are numerous. Most notably, by creating a hydrophobic polishing pad which can be wetted, wafer polishing efficiency can be improved and wafer polishing costs may be lowered. The claimed invention reduces the problems of a polishing pad absorbing too much moisture and losing structural integrity. Therefore, the present invention allows more CMP operations to be conducted before the polishing pad must be changed thus increasing CMP processing output and lowering costs of CMP processing by increasing the life of each polishing pad.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

The purpose of this invention is to produce a polishing pad or belt or other device with increased resistance to moisture absorption for improved wafer planarizing effectiveness and consistency. This invention overcomes the limitations of the present polishing pads through the use of a hydrophobic polishing pad material with hydrophilic additives. Although the descriptions of the invention refer to pads, the invention can be in any suitable form or shape, including but not limited to sheets, belts, disks, rollers and bobs.

Figure 1:
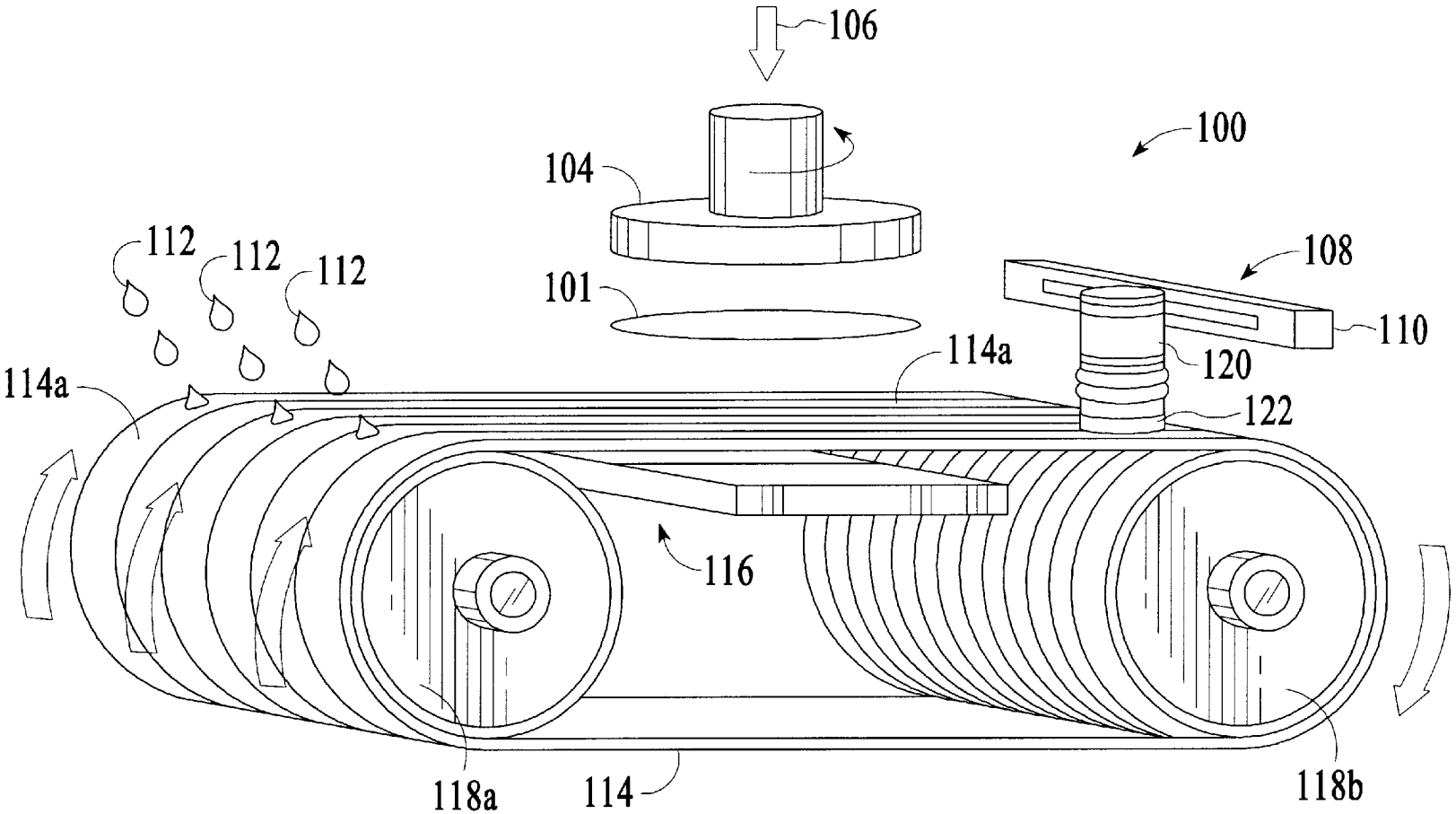
FIG. 1 shows a view of an exemplary CMP system in accordance with one embodiment of the present invention.

FIG. 1 shows a view of an exemplary CMP system 100 in accordance with one embodiment of the present invention. A polishing head 104 may be used to secure and hold the wafer 101 in place during processing. A linear belt polishing pad 114 is preferably secured to a thin metal belt (not shown), which forms a continuous loop around rotating drums 118*a* and 118*b*. The linear belt polishing pad 114 may be secured to the metal belt by using a well-known glue or other adhesive material. The linear belt polishing pad 114 itself is preferably hydrophobic and made out of a polymeric matrix material 201 (shown in FIG. 2) with an additive 202 that is hydrophilic (also shown in FIG. 2). This combination of hydrophilic and hydrophobic materials serves to improve pad longevity and wetting as described in the discussion regarding FIG. 2. The linear belt polishing pad 114 generally rotates in a direction indicated by the arrows at a speed of about 400 feet per minute. As the belt rotates, polishing slurry 112 may be applied and spread over the surface 114*a* of the linear belt polishing pad 114. The polishing head 104 may then be used to lower the wafer 101 onto the surface 114*a* of the rotating linear belt polishing pad 114. In this manner, the surface of the wafer 101 that is desired to be planarized is substantially smoothed.

In some cases, the CMP operation is used to planarize materials such as oxide, and in other cases, it may be used to remove layers of metal. The rate of polishing may be changed by adjusting the polishing pressure 106. The polishing rate is generally proportional to the amount of polishing pressure 106 applied to the linear belt polishing pad 114 against the polishing pad stabilizer 116. After the desired amount of material is removed from the surface of the wafer 101, the polishing head 104 may be used to raise the wafer 101 off of the linear belt polishing pad 114. The wafer is then ready to proceed to the next step in the manufacturing process.

The CMP system 100 can be improved for the next wafer by conditioning the surface of the linear belt polishing pad 114. Conditioning of the pad may be performed by removing excess slurry and residue build-up from the clogged belt pad. As more wafers are planarized, the belt pad will collect more residue build-up which can make efficient CMP operations difficult. One method of conditioning the belt pad is to use a polishing pad conditioning system 108. A conditioning head 120 is preferably used to hold (and in some embodiments rotate) a conditioning disk 122 as a conditioning track 110 holds the conditioning head 120. The conditioning track 110 moves the conditioning head 120 back and forth as the conditioning disk 122 scrapes the linear belt polishing pad 114, preferably with a nickel-plated conditioning disk.

As explained in further detail below, a pad such as the linear belt polishing pad 114 is hydrophobic and therefore does not absorb moisture from the polishing slurry 112. Therefore, the linear belt polishing pad 114 does not swell, soften, or lose its rigidity through the polishing process. Moreover, as seen below, pads such as the linear belt polishing pad 114 maintain their integrity while at the same time holding the polishing slurry 112. This use of hydrophilic additives helps maintain polishing pad wetting for optimal wafer polishing.

Figure 2:
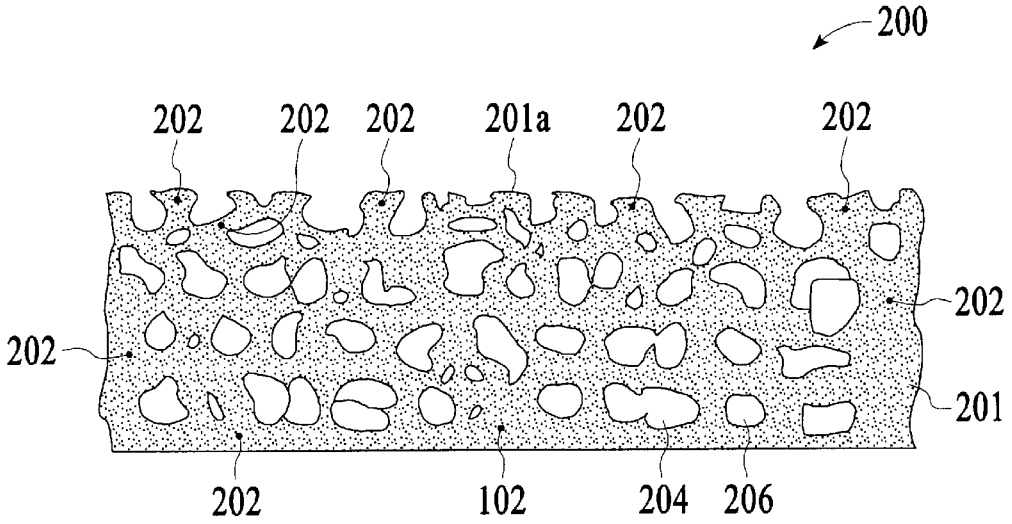
FIG. 2 shows a detailed side view of a polishing pad in accordance with one embodiment of the present invention.

FIG. 2 shows a detailed side view of a polishing pad 200 in accordance with one embodiment of the present invention. In this embodiment, the polishing pad 200 is made of a polymeric matrix material 201. The polymeric matrix material 201 includes an additive 202 which is interspersed throughout the polymeric matrix material 201. The additive 202 is hydrophilic and therefore attracts aqueous solutions such as the polishing slurry 112. The polymeric matrix material 201 also contains open cells 204 and closed cells 206. The open cells 204 and the closed cells 206 are spaces (or pores) within the polymeric matrix material 201 that can become exposed to the outside when the polishing pad 200 becomes worn with use. The cells 204 and 206 which are exposed become invaginated features of a pad surface 201*a* which can hold the polishing slurry 112. The open cells 204 are two or more connected cells with an opening between them while the closed cells 206 are individual cells that are not connected with other cells. The polishing pad 200 also has a pad surface 201*a* that contacts and polishes a semiconductor wafer during a CMP polishing process. During the polishing process, the polishing pad 200, because of the hydrophobic nature of its polymeric matrix material 201, does not absorb the moisture from the polishing slurry 112. The polymeric matrix material 201 can be any polymeric material or any combination of polymeric materials, including thermoplastic and cross-linked materials, that absorbs less than about 4% by weight of moisture after soaking in a solution (e.g., water or any other basic or acidic solution) for a period of time. For example, the period of time may be for about 24 hours. In one embodiment, the thermoplastic materials which may be used are, for example, polytetrafluoroethylene, polyethylene, ABS polypropylene, fluoronated polymers, polyurethane, thermoplastic elastomers, polycarbonate, and the like. The cross-linked materials which may be used are, for example, polyurethane, phenolics, epoxies, various natural and synthetic rubbers, other thermoset materials, and the like.

The polishing pad 200 can include a porous structure. The porosity can be achieved by any suitable method, including but not limited to blowing, frothing, and inclusion of filled or unfilled hollow microelements. The pores can be any combination or distribution of size, shape, and quality (open or closed cells as indicated above).

The polishing pad 200 can include any type of texturing or groove patterns, formed naturally or by any suitable methods. The texturing can be created during the manufacturing process, or it can be created during use.

The additive 202 which is suitable for improving wetting and distribution of slurry include any type of hydrophilic additives like surfactants, and relatively polar polymeric materials including but not limited to polyurethanes, polyamides, polyesters, polyacrylonitriles, polyacrylates, polymethacrylates, polyvinylchlorides, and polyvinylidene chlorides. Relatively polar polymeric materials include materials that have enough polarity to be hydrophilic. The additive 202 can be liquid, solid, semi-solid, or combinations of solid and liquid. For example, the surfactant may be a liquid or a paste while polyurethanes, polyamides, and polyesters are typically solid. The additive 202 can be reactive or non-reactive with the other materials in the polishing pad. In one example, the additive 202 may react with the polymeric matrix material 201 to actually bond with the polymeric matrix material 201. The additive 202 can be located within the polymer matrix or within the pores (or cells) of the polishing material. The additive 202 can be any shape, size, or distribution, and can perform additional functions (e.g., hydrophilic hollow beads used to increase wetting and to create porosity). The additive 202 can remain in place and wear away with the polishing material, or they can pop out or smear to coat, fill in, or otherwise improve the interaction between the pad surface 201*a* and the polishing slurry 112. By way of example, the additive 202 can be loosely held within the polymeric matrix material 201, and when the polishing pad 200 becomes worn down, the additive 202 may be squeezed out of the polymeric matrix 201. In that case, the additive 202 may be smeared onto the surface of the wafer 100 by the pressure exerted by the polishing pad 200. In any event, the additive 202 improves the interaction between the pad surface 201*a* and the polishing slurry 112 by attracting the polishing slurry 112 to the hydrophobic polishing pad 200 by hydrophilic interactions.

Figure 3:
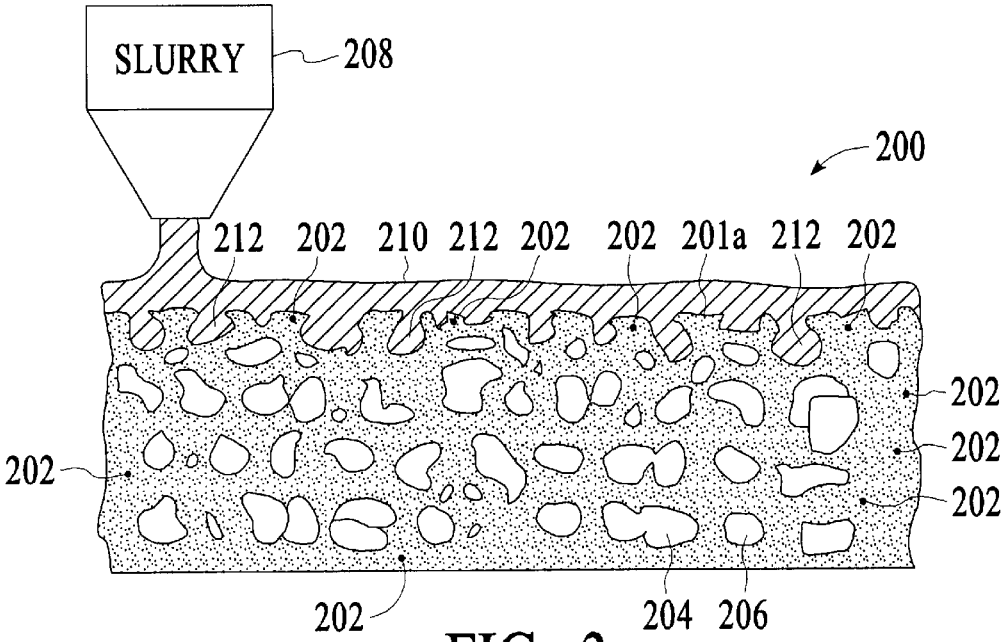
FIG. 3 shows a polishing pad with a slurry coating in accordance with one embodiment of the present invention.

FIG. 3 shows a polishing pad 200 with a slurry coating 210 in accordance with one embodiment of the present invention. In this embodiment, the polishing pad 200, as described in FIG. 1, is being used in conjunction with the slurry coating 210 poured from a slurry dispenser 208. The slurry coating 210 may be any solution with abrasive particulates which can be used for a CMP process such as a solution having $Al_2O_3$ or silica abrasive and other chemical components. However, it should be understood by one of ordinary skill in the art that various other chemical compositions of the slurry coating 210 that work with metals such as copper or whatever substrate being polished may be used. The slurry coating 210 is dispensed to the polishing pad 200 before the start of the CMP process to fully wet the polishing pad 200. After the slurry coating 210 has been dispensed, the wafer 101 is lowered onto the polishing pad 200 for the CMP process. The slurry coating 210 is held by the polymeric matrix material 201 of the polishing pad 200 because of the additive 202 and indentations (or invaginated features) formed by cells 212.

The polishing pad 200 is capable of being wetted by the slurry coating 210 even though the polymeric matrix material 201 is hydrophobic because the additive 202 within the polymeric matrix material 201 is hydrophilic. The additive 202 attracts the slurry coating 210 while the rest of the polishing pad 200 repels the slurry. This combination of repulsion and attraction helps to maintain the integrity of the polishing pad 200 while creating the wetting needed for optimal wafer polishing. In addition, the cells 212 which are exposed to the slurry coating 210 holds the slurry coating 210 within it and contributes to the wetting of the polishing pad 200.

What is claimed is:

1. A polishing pad for use in chemical mechanical polishing (CMP), comprising:

a pad surface for polishing wafer surfaces, the pad surface being composed of a polymeric matrix material, the polymeric matrix material being hydrophobic; and a polymeric additive being defined in the polymeric matrix of the pad surface and in cells of the pad surface, the polymeric additive includes one of a polyurethane, a polyamide, a polyester, a polyacrylonitrile, a polyacrylate, a polymethacrylate, a polyvinylchloride, and a polyvinylidene chloride;

wherein the polymeric additive is configured to be hydrophilic such that the pad surface is rendered partially hydrophobic by the polymeric matrix material and partially hydrophilic by the polymeric additive making the pad surface wettable to enable improved slurry distribution over the pad surface.

2. A polishing pad for use in chemical mechanical polishing (CMP) as recited in claim 1, wherein the polymeric matrix material being configured to absorb less than about 4% moisture.

3. A polishing pad for use in chemical mechanical polishing (CMP) as recited in claim 2, wherein the polymeric matrix material is one of a thermoplastic material and a cross-linked material.

4. A polishing pad for use in chemical mechanical polishing (CMP) as recited in claim 2, wherein the polymeric matrix material is a combination of a thermoplastic material and a cross-linked material.

5. A polishing pad for use in chemical mechanical polishing (CMP) as recited in claim 3, wherein the thermoplastic material is selected from the group consisting of a polytetrafluoroethylene material, a polyethylene material, an acrylonitrile butadiene styrene (ABS) material, a polypropylene material, a fluoronated polymer material, a polyurethane material, a thermoplastic elastomer material, and a polycarbonate material.

6. A polishing pad for use in chemical mechanical polishing (CMP) as recited in claim 3, wherein the cross-linked material is selected from the group consisting of a polyurethane material, a phenolic material, an epoxy material, a natural or synthetic rubber material, and a thermoset material.

7. A polishing pad for use in chemical mechanical polishing (CMP) as recited in claim 2, wherein the less than about 4% moisture is absorbed after soaking for about 24 hours.

8. A polishing pad for use in chemical mechanical polishing (CMP) as recited in claim 1, wherein the polymeric matrix material is defined by cells that extend into the pad, and some cells at the pad surface defining invaginated features for receiving the slurry.

9. A polishing pad for use in chemical mechanical polishing (CMP), comprising:

a pad surface for polishing wafer surfaces, the pad surface being composed of a relatively non-polar polymeric matrix material;

an additive being defined in the polymeric matrix of the pad surface and in cells of the pad surface, the additive being a surfactant;

wherein the additive is configured to be hydrophilic such that a portion of the pad surface made up of the polymeric matrix material is hydrophobic and the portion of the pad surface made up of the additive is hydrophilic so the pad surface is wettable to enable improved slurry distribution over the pad surface.

10. A polishing pad for use in chemical mechanical polishing (CMP) as recited in claim 9, wherein the polymeric matrix material being configured to absorb less than about 4% moisture.

11. A polishing pad for use in chemical mechanical polishing (CMP) as recited in claim 10, wherein the less than about 4% moisture is absorbed after soaking for about 24 hours.

12. A polishing pad for use in chemical mechanical polishing (CMP) as recited in claim 10, wherein the polymeric matrix material is defined by cells that extend into the pad, and some cells at the pad surface defining invaginated features for receiving the slurry.

13. A polishing system including a polishing pad for use in chemical mechanical polishing (CMP), comprising:

a pad surface for polishing wafer surfaces, the pad surface being composed of a polymeric matrix material, the polymeric matrix material being hydrophobic, the polymeric matrix material includes one of a thermoplastic material and a cross-linked material; and a polymeric additive being defined in the polymeric matrix of the pad surface and in cells of the pad surface, the polymeric additive includes one of a polyurethane, a polyamide, a polyester, a polyacrylonitrile, a polyacrylate, a polymethacrylate, a polyvinylchloride, and a polyvinylidene chloride;

the additive is configured to be hydrophilic such that the pad surface is wettable to enable improved slurry distribution over the pad surface, and the polymeric matrix material is configured to absorb less than about 4% moisture by weight;

wherein the thermoplastic material is selected from the group consisting of a polytetrafluoroethylene material, a polyethylene material, an acrylonitrile butadiene styrene (ABS) material, a polypropylene material, a fluoronated polymer material, a polyurethane material, a thermoplastic elastomer material, and a polycarbonate material;

wherein the cross-linked material is selected from the group consisting of a polyurethane material, a phenolic material, an epoxy material, a natural or synthetic rubber material, and a thermoset material.

14. A polishing system including a polishing pad for use in chemical mechanical polishing (CMP) as recited in claim 13, wherein the polymeric matrix material is defined by cells that extend into the pad, and some cells at the pad surface defining invaginated features for receiving the slurry.

15. A polishing pad as recited in claim 13, wherein the polymeric additive is in the form of hydrophilic hollow beads.

16. A polishing pad, comprising:

a pad surface for polishing wafer surfaces, the pad surface being composed of a polymeric matrix material, the polymeric matrix material being hydrophobic, the polymeric matrix material includes one of a thermoplastic material and a cross-linked material, and the polymeric matrix material is defined by cells that extend into the pad, and some cells at the pad surface defining invaginated features for receiving the slurry; and a polymeric additive being defined in the polymeric matrix of the pad surface and in cells of the pad surface, the polymeric additive includes one of a polyamide and a polyester, the additive is configured to be hydrophilic such that the pad surface is rendered partially hydrophobic by the polymeric matrix material and partially hydrophilic by the polymeric additive making the pad surface wettable to enable improved slurry distribution over the pad surface;

wherein the thermoplastic material is selected from the group consisting of a polytetrafluoroethylene material, a polyethylene material, an acrylonitrile butadiene styrene (ABS) material, a polypropylene material, a fluoronated polymer material, a polyurethane material, a thermoplastic elastomer material, and a polycarbonate material;

wherein the cross-linked material is selected from the group consisting of a polyurethane material, a phenolic material, an epoxy material, a natural or synthetic rubber material, and a thermoset material.

17. A polishing pad as recited in claim 16, wherein the polymeric matrix material is configured to absorb less than about 4% moisture.

18. A polishing pad for use in chemical mechanical polishing (CMP), comprising:

a pad surface for polishing wafer surfaces, the pad surface being composed of a hydrophobic polymeric matrix material; and a polymeric additive being defined in the polymeric matrix of the pad surface and in cells of the pad surface, the polymeric additive being a polyamide;

wherein a portion of the pad surface made up of the polymeric matrix material is hydrophobic and the portion of the pad surface made up of the additive is hydrophilic.

19. A polishing system including a polishing pad for use in chemical mechanical polishing (CMP) as recited in claim 13, wherein the less than about 4% moisture is absorbed after soaking for about 24 hours.

20. A polishing system including a polishing pad for use in chemical mechanical polishing (CMP) as recited in claim 18, wherein the polymeric matrix material is configured to absorb less than about 4% moisture.

* * * * *